US005140838A

United States Patent [19]

Komeyama et al.

[11] Patent Number: 5,140,838

[45] Date of Patent: Aug. 25, 1992

[54] DRIVING APPARATUS FOR ROLLING MILL

[75] Inventors: Nobuo Komeyama, Nara; Tetsuo Hirasawatsu, Kashiwara, both of Japan

[73] Assignee: Koyo Seiko Co., Ltd., Osaka, Japan

[21] Appl. No.: 716,988

[22] Filed: Jun. 18, 1991

[30] Foreign Application Priority Data

Jul. 6, 1990 [JP] Japan ..... 2-72541[U]

[51] Int. Cl.[5] ..... B21B 35/14

[52] U.S. Cl. ..... 72/249

[58] Field of Search ..... 72/247, 249, 21, 443; 403/57, 58, DIG. 2

[56] References Cited

U.S. PATENT DOCUMENTS 4,385,512 5/1983 Matsumoto et al. ..... 72/366.2

4,848,635 7/1989 Lauener et al. ..... 72/249

FOREIGN PATENT DOCUMENTS 0264204 11/1988 Japan ..... 72/237

*Primary Examiner*—Lowell A. Larson

*Assistant Examiner*—Thomas C. Schoeffler

[57] ABSTRACT

Driving apparatus for a rolling mill includes upper and lower work rolls for rolling a workpiece having a longitudinal axis lying in a horizontal plane, upper and lower driving shafts for driving the upper and lower work rolls, respectively, an upper universal joint operatively coupling the upper work roll to the upper driving shaft, and a lower universal joint operatively coupling the lower work roll to the lower driving shaft. The upper and lower work rolls have axes lying in planes parallel to the horizontal plane of the workpiece longitudinal axis and are slanted in opposite directions with respect to the longitudinal axis of the workpiece. The upper and lower driving shafts are disposed symmetrically with respect to the horizontal plane of the workpiece longitudinal axis and a vertical plane passing through the workpiece longitudinal axis. The upper and lower universal joints have yokes at angles which are 90 degrees out of phase with each other, whereby the phase angles of the corresponding upper and lower universal joints are 90 degrees out of phase and the rotation speeds of the upper and lower work rolls are equalized.

1 Claim, 2 Drawing Sheets

DRIVING APPARATUS FOR ROLLING MILL

BACKGROUND OF THE INVENTION

The present invention relates to a driving apparatus for a rolling mill called a pair cross mill, and more particularly relates to an improved driving apparatus which is for a rolling mill called a pair cross mill and in which work rolls are coupled to driving shafts through universal joints.

FIG. 3(*a*) is a simplified plan view of a conventional driving apparatus for a rolling mill called a pair cross mill.

FIG. 3(*b*) is a simplified front view of the driving apparatus.

The rolling mill includes upper and lower work rolls 1 and 2 which appear to extend across each other when viewed vertically from the top but appear to extend parallel to each other when viewed horizontally from the front. That is, the axes of upper and lower work rolls 1 and 2 lie in planes parallel to the plane of a workpiece between upper and lower work rolls 1 and 2, and are slanted in opposite directions with respect to the longitudinal axis of the workpiece.

The driving apparatus includes a motor not shown in the drawings, upper and lower driving shafts 3 and 4, upper and lower intermediate shafts 5 and 6, two upper universal joints 7A and 7B, and two lower universal joints 8A and 8B. The driving shafts 3 and 4, which are driven by the single motor, appear identical when viewed vertically from the top, but appear to extend parallel to each other when viewed horizontally from the front. The upper and the lower work rolls 1 and 2 are coupled to the upper and the lower driving shafts 3 and 4 by the upper and the lower intermediate shafts 5 and 6 and the upper and the lower universal joints 7A, 7B, 8A and 8B, respectively. The upper driving unit of the driving apparatus includes the upper driving shaft 3, the upper intermediate shaft 5 and the upper universal joints 7A and 7B. The lower driving unit of the driving apparatus includes the lower driving shaft 4, the lower intermediate shaft 6 and the lower universal joints 8A and 8B. The upper and the lower driving units are disposed symmetrically with regard to horizontal and vertical planes $Z_1$ and $Z_2$. Since such universal joints are relatively low in cost of acquisition and maintenance and high in motive power transmitting property, studies are being made to use the joints for the pair cross rolling mill as well as for ordinary rolling mills.

To equalize the rotation speeds of the driving shafts 3 and 4 and the work rolls 1 and 2 to each other, the following conditions must be met: (1) the yokes of the upper universal joints 7A and 7B are attached at identical angles to the end of the upper intermediate shaft 5, and the yokes of the lower universal joints 8A and 8B are attached at identical angles to the other ends of the lower intermediate shaft 6; (2) the shaft operating angle of the universal joints 7A and 7B to be paired are equal and the shaft operating angle of the universal joints 8A and 8B to be paired are equal; and (3) the axes of the components of the upper driving unit are coplanar, and the axes of the components of the lower driving unit are coplanar. However, since for the pair cross mill more importance is attached to the single motor being used as a driving power source for the two driving shafts 3 and 4, the installation space for the driving apparatus is minimized by reducing the width l of the apparatus. For that reason, the above-mentioned conditions need to be partially ignored in some cases. In those cases, the phase angles of the work rolls lead and lag each other. In reality, however, the phase angles of the work rolls 1 and 2 not only lead and lag each other, but also they are 90 degrees out of phase with each other, as shown in FIGS. 4(*a*) and 4(*b*), due to the fact that the direction of rotation of the upper work roll 1 and the direction of rotation of the lower work roll 2 are opposite to each other. For that reason, the slip of a workpiece between the upper and the lower work rolls 1 and 2 becomes so large that the driving apparatus cannot be put in practical use even in the case of rolling at the low speed, the case of rolling of the thick plate, or the like. This is a problem.

SUMMARY OF THE INVENTION

The present invention was made in order to solve the above-mentioned problem.

Accordingly, it is an object of the present invention to provide a driving apparatus which is for a pair cross rolling mill and is such that the phase angles of the upper and lower work rolls of the mill are made coincident with each other to prevent the slip of a workpiece between the work rolls as much as possible.

In the driving apparatus, the upper and the lower work rolls appear to extend across each other when viewed vertically from the top but appear to extend parallel to each other when viewed horizontally from the front; the upper and lower driving shafts of the apparatus are disposed symmetrically with regard to horizontal and vertical planes; the upper driving shafts are coupled to each other by upper universal joints; and the lower driving shafts are coupled to each other by lower universal joints. The driving apparatus is characterized in that the phase angles of the corresponding upper and lower universal joints are made 90 degrees out of phase with each other by making the angles of the yokes of the corresponding upper and lower univeral joints 90 degrees out of phase with each other. As a result, the upper and the lower work rolls, which are rotated in mutually reverse directions, coincide with each other in lead and lag phases. The disposition of the yokes of the upper and the lower universal joints are thus simply improved to prevent the upper and the lower work rolls from differing from each other in lead and lag phases so as to slip the workpiece being rolled by the rolling mill. Therefore, the above-mentioned problem is solved.

In the driving apparatus, either a single such universal joint or double such universal joints may be provided between each work roll and the corresponding driving shaft.

DESCRIPTION OF THE DRAWINGS

FIG. 1(*b*) is a simplified front view of the driving apparatus;

FIG. 2(*b*) is a graph showing the lead and lag in the phase of the lower work roll of the rolling mill;

FIG. 3(*b*) is a simplified front view of the conventional driving apparatus;

FIG. 4(*b*) is a graph showing the lead and lag in the phase of the lower work roll of the rolling mill shown in FIGS. 3(*a*) and 3(*b*).

DETAILED DESCRIPTION OF EXEMPLARY EMBODIMENT

An embodiment of the present invention is hereafter described in detail with reference to the drawings attached hereto.

Figure 1A:
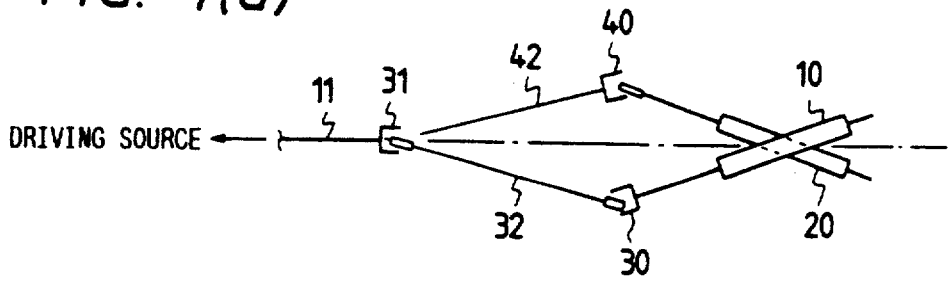
FIG. 1(*a*) is a simplified plan view of a driving apparatus which is an embodiment of the present invention and is for a rolling mill.
Figure 1B:
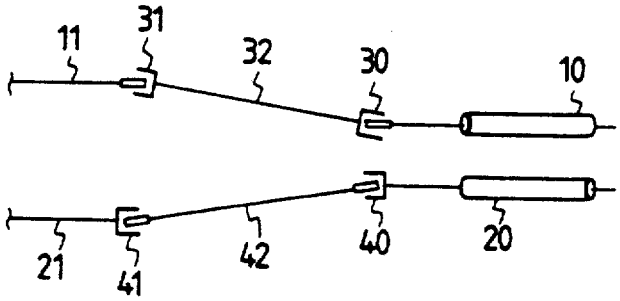
Figure 2A:
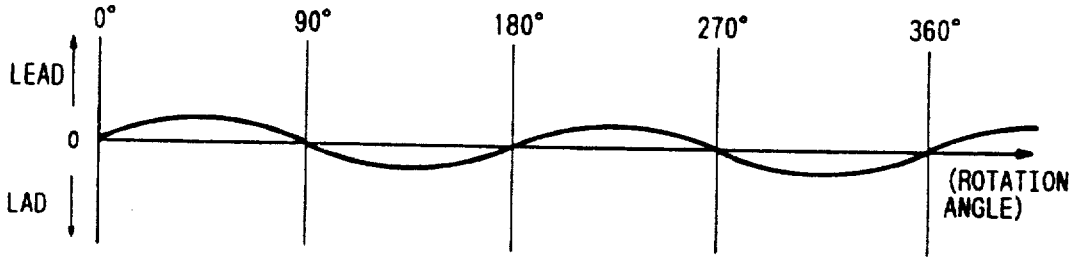
FIG. 2(*a*) is a graph showing the lead and lag in the phase of the upper work roll of the rolling mill.
Figure 2B:
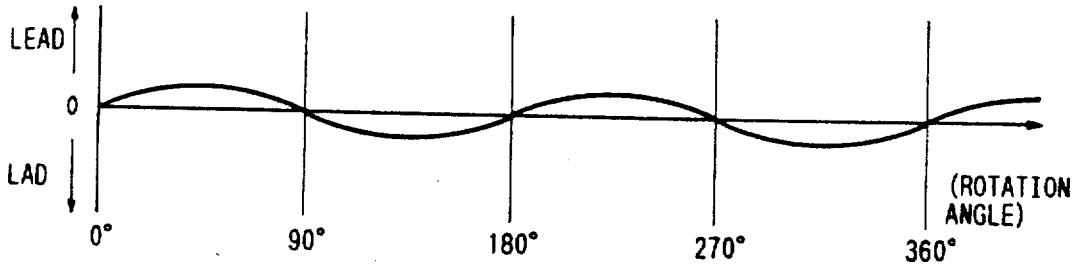
Figure 3A:
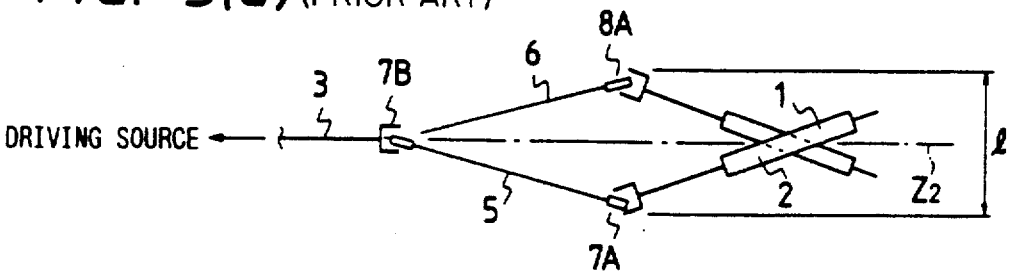
FIG. 3(a) (PRIOR ART)
FIG. 3(*a*) is a simplified plan view of a conventional driving apparatus for a rolling mill.
Figure 3B:
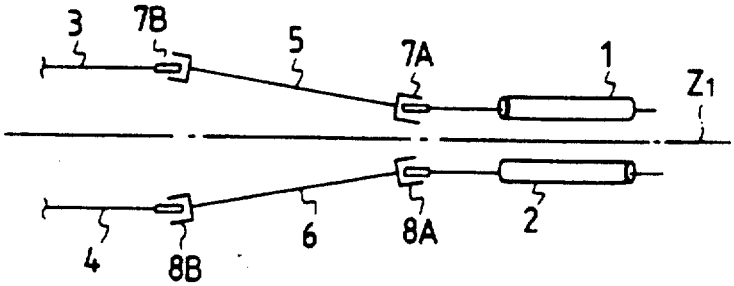
FIG. 3(b) (PRIOR ART)
Figure 4A:
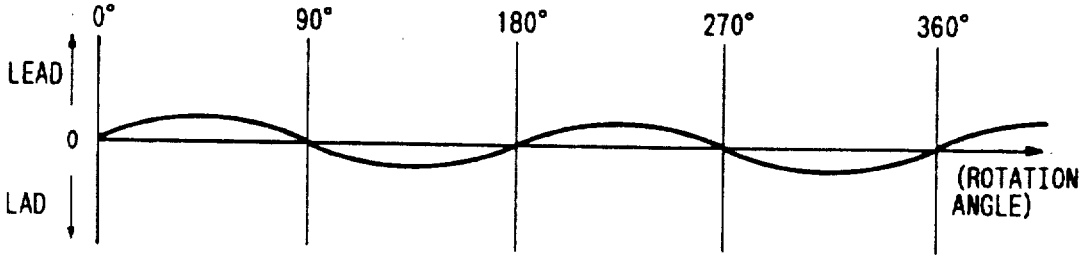
FIG. 4(a) (PRIOR ART)
FIG. 4(*a*) is a graph showing the lead and lag in the phase of the upper work roll of the rolling mill shown in FIGS. 3(*a*) and 3(*b*)
Figure 4B:
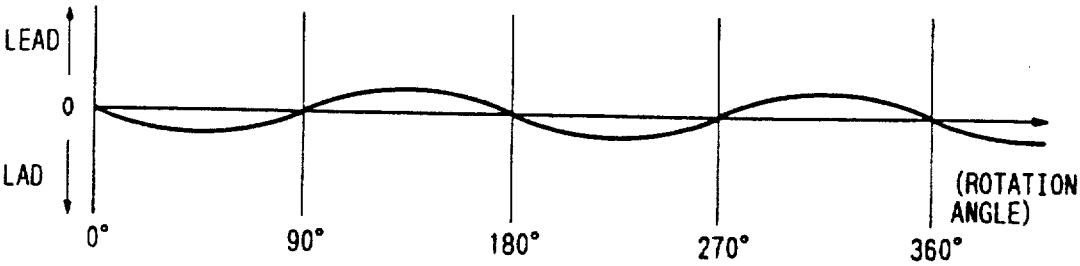
FIG. 4(b) (PRIOR ART)

A driving apparatus which is the embodiment and is for a rolling mill includes upper and lower driving shafts 11 and 21, upper and lower intermediate shafts 32 and 42, first and second upper universal joints 30 and 31 provided at the first and second ends of the upper intermediate shaft 32, and first and second lower universal joints 40 and 41 provided at the first and second ends of the lower intermediate shaft 42. The upper and lower work rolls 10 and 20 of the rolling mill are coupled to the upper and the lower driving shafts 11 and 21 by the first upper and the first lower universal joints 30 and 40, the upper and the lower intermediate shafts 32 and 42, and the second upper and the second lower universal joints 31 and 41, respectively. The upper driving unit of the driving apparatus includes the upper intermediate shaft 32, and the upper universal joints 30 and 31. The lower driving unit of the driving apparatus includes the lower intermediate shaft 42, and the lower universal joints 40 and 41. The difference of the driving apparatus from the conventional driving apparatus shown in FIGS. 3(*a*) and 3(*b*) is that the lead and lag phases of the lower universal joints 40 and 41 provided at the ends of the lower intermediate shaft 42 are made 90 degrees out of phase from those of the upper universal joints 30 and 31 provided at the ends of the upper intermediate shaft 32, as shown in FIGS. 1(*a*) and 1(*b*), by making the angles of corresponding first upper and lower universal joints 30 and 40 90 degrees out of phase with each other and by making the angles of corresponding second upper and lower universal joints 31 and 41 90 degrees out of phase with each other. In consideration of the fact that the difference between the lead and lag phases of the work rolls 1 and 2 coupled to the conventional driving apparatus is 90 degrees as shown in FIGS. 4(*a*) and 4(*b*), the lead and lag phase angles of the upper and the lower universal joints of the driving apparatus which is the embodiment are made different from each other by 90 degrees angles, as mentioned above, so that the lead and lag phase angles of the upper and the lower work rolls 10 and 20 coupled to the latter driving apparatus coincide with each other, as shown in FIGS. 2(*a*) and 2(*b*). This is understood from the general characteristics of a single such universal joint.

The present invention is not confined to the embodiment described above, but may be embodied or practiced in other various ways without departing from the spirit or essential character of the invention. For example, each of the upper and the lower driving units may be constituted not to include the intermediate shaft but to include a single universal joint at which the work roll is coupled to the driving shaft.

What is claimed is:

1. Driving apparatus for a rolling mill, comprising:

upper and lower work rolls for rolling a workpiece having a longitudinal axis lying in a horizontal plane, said upper and lower work rolls having axes lying in planes parallel to the horizontal plane of the workpiece longitudinal axis and slanted in opposite directions with respect to the longitudinal axis of the workpiece;

upper and lower driving shafts for driving said upper and lower work rolls, respectively, said upper and lower driving shafts being disposed symmetrically with respect to the horizontal plane of the workpiece longitudinal axis and a vertical plane passing through the workpiece longitudinal axis;

an upper universal joint operatively coupling said upper work roll to said upper driving shaft; and a lower universal joint operatively coupling said lower work roll to said lower driving shaft;

wherein said upper and lower universal joints have yokes at angles which are 90 degrees out of phase with each other.

* * * * *